US010382864B2

(12) United States Patent
Alderson et al.

(10) Patent No.: US 10,382,864 B2
(45) Date of Patent: Aug. 13, 2019

(54) SYSTEMS AND METHODS FOR PROVIDING ADAPTIVE PLAYBACK EQUALIZATION IN AN AUDIO DEVICE

(71) Applicant: Cirrus Logic, Inc., Austin, TX (US)

(72) Inventors: Jeffrey D. Alderson, Austin, TX (US); Jon D. Hendrix, Wimberley, TX (US)

(73) Assignee: Cirrus Logic, Inc., Austin, TX (US)

( * ) Notice: Subject to any disclaimer, the term of this patent is extended or adjusted under 35 U.S.C. 154(b) by 816 days.

(21) Appl. No.: 14/101,777

(22) Filed: Dec. 10, 2013

(65) Prior Publication Data

US 2015/0161980 A1 Jun. 11, 2015

(51) Int. Cl.
*H04R 3/04* (2006.01)
*G10K 11/178* (2006.01)

(52) U.S. Cl.
CPC ..... *H04R 3/04* (2013.01); *G10K 11/178* (2013.01); *G10K 11/17881* (2018.01); *G10K 11/17885* (2018.01); *G10K 2210/1081* (2013.01); *H04R 2410/05* (2013.01)

(58) Field of Classification Search
CPC ..... G10K 11/1784; G10K 2210/1081; G10K 2410/05; H04R 3/04
See application file for complete search history.

(56) References Cited

U.S. PATENT DOCUMENTS 5,117,401 A 5/1992 Feintuch
5,251,263 A 10/1993 Andrea et al.
5,278,913 A 1/1994 Delfosse et al.
5,321,759 A 6/1994 Yuan
5,337,365 A 8/1994 Hamabe et al.
(Continued)

FOREIGN PATENT DOCUMENTS

DE 102011013343 A1 9/2012
EP 0412902 A2 2/1991
(Continued)

OTHER PUBLICATIONS

International Patent Application No. PCT/US2015/017124, International Search Report and Written Opinion, dated Jul. 13, 2015, 19 pages.

(Continued)

*Primary Examiner* — Ping Lee
(74) *Attorney, Agent, or Firm* — Jackson Walfer L.L.P.

(57) ABSTRACT

In accordance with systems and methods of the present disclosure, a method may include receiving an error microphone signal indicative of an acoustic output of a transducer and ambient audio sounds at the acoustic output of the transducer. The method may also include generating an anti-noise signal to reduce the presence of the ambient audio sounds at the acoustic output of the transducer based at least on the error microphone signal. The method may further include generating an equalized source audio signal from a source audio signal by adapting, based at least on the error microphone signal, a response of the adaptive playback equalization system to minimize a difference between the source audio signal and the error microphone signal. The method may additionally include combining the anti-noise signal with the equalized source audio signal to generate an audio signal provided to the transducer.

33 Claims, 5 Drawing Sheets

(56) References Cited

U.S. PATENT DOCUMENTS 5,359,662 A 10/1994 Yuan et al.
5,377,276 A 12/1994 Terai et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A * 1/1996 Eatwell ..... G10K 11/1784 381/71.6
5,548,681 A 8/1996 Gleaves et al.
5,559,893 A 9/1996 Krokstad
5,586,190 A 12/1996 Trantow et al.
5,640,450 A 6/1997 Watanabe
5,668,747 A 9/1997 Ohashi
5,696,831 A 12/1997 Inanga
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,317,501 B1 11/2001 Matsuo
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,406,179 B2 7/2008 Ryan
7,466,838 B1 12/2008 Moseley
7,555,081 B2 6/2009 Keele, Jr.
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,155,334 B2 4/2012 Joho et al.
8,249,262 B2 8/2012 Chua et al.
8,290,537 B2 10/2012 Lee et al.
8,325,934 B2 12/2012 Kuo
8,363,856 B2 1/2013 Lesso
8,374,358 B2 2/2013 Buck et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,539,012 B2 9/2013 Clark
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,909,524 B2 12/2014 Stoltz et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,020,160 B2 4/2015 Gauger, Jr.
9,066,176 B2 6/2015 Hendrix et al.
9,082,391 B2 7/2015 Yermech et al.
9,094,744 B1 7/2015 Lu et al.
9,106,989 B2 8/2015 Li et al.
9,107,010 B2 8/2015 Abdollahzadeh Milani et al.
9,203,366 B2 12/2015 Eastty
9,264,808 B2 2/2016 Zhou et al.
9,294,836 B2 3/2016 Zhou et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0001450 A1 1/2004 He et al.
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr.
2004/0196992 A1 10/2004 Ryan
2004/0202333 A1 10/2004 Czermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0018460 A1 1/2006 McCree
2006/0035593 A1 2/2006 Leeds
2006/0055910 A1 3/2006 Lee
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038447 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammed et al.
2008/0240455 A1 10/2008 Inoue et al.
2008/0240457 A1 10/2008 Innoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.

(56) References Cited

U.S. PATENT DOCUMENTS

2010/0124335 A1 5/2010 Shridhar et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Marcel et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0310087 A1 12/2010 Ishida
2010/0316225 A1 12/2010 Saito et al.
2010/0322430 A1 12/2010 Isberg
2011/0002468 A1 1/2011 Tanghe
2011/0007907 A1 1/2011 Park et al.
2011/0026724 A1 2/2011 Doclo
2011/0096933 A1* 4/2011 Eastty ..... H03G 3/00 381/98
2011/0099010 A1 4/2011 Zhang
2011/0106533 A1 5/2011 Yu
2011/0116643 A1 5/2011 Tiscareno
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0207317 A1* 8/2012 Abdollahzadeh Milani ..... G10K 11/1784 381/71.6
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0083939 A1* 4/2013 Fellers ..... G10K 11/178 381/71.11
2013/0156238 A1 6/2013 Birch et al.
2013/0222516 A1 8/2013 Do et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0036127 A1 2/2014 Pong et al.
2014/0044275 A1 2/2014 Goldstein et al.
2014/0050332 A1 2/2014 Nielsen et al.
2014/0051483 A1 2/2014 Schoerkmaier
2014/0072134 A1 3/2014 Po et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270223 A1 9/2014 Li et al.
2014/0270224 A1 9/2014 Zhou et al.
2014/0277022 A1 9/2014 Hendrix et al.
2014/0294182 A1 10/2014 Axelsson
2014/0307887 A1 10/2014 Alderson et al.
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellman
2014/0314247 A1 10/2014 Zhang
2014/0341388 A1 11/2014 Goldstein
2014/0369517 A1 12/2014 Zhou et al.
2015/0078572 A1 3/2015 Milani et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0256660 A1 9/2015 Kaller et al.
2015/0256953 A1 9/2015 Kwatra et al.
2015/0269926 A1 9/2015 Alderson et al.
2015/0365761 A1 12/2015 Alderson et al.
2016/0180830 A1 6/2016 Lu et al.

FOREIGN PATENT DOCUMENTS

EP 0756407 A2 1/1997
EP 0898266 A2 2/1999
EP 1691577 A2 8/2006
EP 1880699 A2 1/2008
EP 1947642 A1 7/2008
EP 2133866 A1 12/2009
EP 2237573 A1 10/2010
EP 2216774 A1 8/2011
EP 239550 A1 12/2011
EP 2395501 A1 12/2011
EP 2551845 A1 1/2013
EP 2583074 A1 4/2013
GB 2401744 A 11/2004
GB 2436657 A 10/2007
GB 2455821 A 6/2009
GB 2455824 A 6/2009
GB 2455828 A 6/2009
GB 2484722 A 4/2012

(56) References Cited

FOREIGN PATENT DOCUMENTS

| | | | |
|---|---|---|---|
| JP | H05265468 | | 10/1993 |
| JP | H06186985 | A | 7/1994 |
| JP | H06232755 | | 8/1994 |
| JP | 07095892 | | 4/1995 |
| JP | 07325588 | A | 12/1995 |
| JP | H07334169 | | 12/1995 |
| JP | H08227322 | | 9/1996 |
| JP | H10247088 | | 9/1998 |
| JP | H10257159 | | 9/1998 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007060644 | | 3/2007 |
| JP | 2008015046 | A | 1/2008 |
| JP | 2010277025 | | 12/2010 |
| JP | 2011061449 | | 3/2011 |
| WO | 1999011045 | | 3/1999 |
| WO | 2003015074 | A1 | 2/2003 |
| WO | 2003015275 | A1 | 2/2003 |
| WO | WO2004009007 | A1 | 1/2004 |
| WO | 2004017303 | A1 | 2/2004 |
| WO | 2006125061 | A1 | 11/2006 |
| WO | 2006128768 | A1 | 12/2006 |
| WO | 2007007916 | A1 | 1/2007 |
| WO | 2007011337 | A1 | 1/2007 |
| WO | 2007110807 | A2 | 10/2007 |
| WO | 2007113487 | A1 | 11/2007 |
| WO | 2009041012 | A1 | 4/2009 |
| WO | 2009110087 | A1 | 9/2009 |
| WO | 2010117714 | A1 | 10/2010 |
| WO | 2011035061 | A1 | 3/2011 |
| WO | 2012107561 | A1 | 8/2012 |
| WO | 2012119808 | A2 | 9/2012 |
| WO | 2012134874 | A1 | 10/2012 |
| WO | 2012166273 | A2 | 12/2012 |
| WO | 2012166388 | A2 | 12/2012 |
| WO | 2013106370 | A1 | 7/2013 |
| WO | 2014158475 | A1 | 10/2014 |
| WO | 2014168685 | A2 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088639 | A1 | 6/2015 |
| WO | 2015088651 | A1 | 6/2015 |
| WO | 2015088653 | A1 | 6/2015 |
| WO | 2015134225 | A1 | 9/2015 |
| WO | 2015191691 | A1 | 12/2015 |
| WO | 2016100602 | A1 | 6/2016 |

OTHER PUBLICATIONS

International Patent Application No. PCT/US2015/035073, International Search Report and Written Opinion, dated Oct. 8, 2015, 11 pages.

International Patent Application No. PCT/US2014/049600, International Search Report and Written Opinion, dated Jan. 14, 2015, 12 pages.

International Patent Application No. PCT/US2014/061753, International Search Report and Written Opinion, dated Feb. 9, 2015, 8 pages.

International Patent Application No. PCT/US2014/061548, International Search Report and Written Opinion, dated Feb. 12, 2015, 13 pages.

International Patent Application No. PCT/US2014/060277, International Search Report and Written Opinion, dated Mar. 9, 2015, 11 pages.

Kuo, Sen and Tsai, Jianming, Residual noise shaping technique for active noise control systems, J. Acoust. Soc. Am. 95 (3), Mar. 1994, pp. 1665-1668.

Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.

International Patent Application No. PCT/US2014/017112, International Search Report and Written Opinion, dated May 8, 2015, 22 pages.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

Cohen, et al., "Noise Estimation by Minima Controlled Recursive Averaging for Robust Speech Enhancement", IEEE Signal Processing Letters, vol. 9, No. 1, Jan. 2002.

Martin, "Noise Power Spectral Density Estimation Based on Optimal Smoothing and Minimum Statistics", IEEE Trans. on Speech and Audio Processing, col. 9, No. 5, Jul. 2001

Martin, "Spectral Subtraction Based on Minimum Statistics", Proc. 7th EUSIPCO '94, Edinburgh, U.K., Sep. 13-16, 1994, pp. 1182-1195.

Cohen, "Noise Spectrum Estimation in Adverse Environments: Improved Minima Controlled Recursive Averaging", IEEE Trans. on Speech & Audio Proc., vol. 11, Issue 5, Sep. 2003.

Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.

Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.

Liu, et al., "Compensatory Responses to Loudness-shifted Voice Feedback During Production of Mandarin Speech", Journal of the Acoustical Society of America, Oct. 2007, pp. 2405-2412, vol. 122, No. 4.

Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.

Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.

Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.

Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.

International Patent Application No. PCT/US2014/017096, International Search Report and Written Opinion, dated May 27, 2014, 11 pages.

Jin, et al., "A simultaneous equation method-based online secondary path modeling algorithm for active noise control", Journal of Sound and Vibration, Apr. 25, 2007, pp. 455-474, vol. 303, No. 3-5, London, GB.

Erkelens et al., "Tracking of Nonstationary Noise Based on Data-Driven Recursive Noise Power Estimation", IEEE Transactions on Audio Speech, and Language Processing, vol. 16, No. 6, Aug. 2008.

Rao et al., "A Novel Two Stage Single Channle Speech Enhancement Technique", India Conference (INDICON) 2011 Annual IEEE, IEEE, Dec. 15, 2011.

(56) References Cited

OTHER PUBLICATIONS

Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, dated Aug. 8, 2014, 22 pages.
International Search Report and Written Opinion of the International Searching Authority, International Patent Application No. PCT/US2014/018027, dated Sep. 4, 2014, 14 pages.
International Search Report and Written Opinion of the International Searching Authority, International Patent Application No. PCT/US2014/017374, dated Sep. 8, 2014, 13 pages.
International Search Report and Written Opinion of the International Searching Authority, International Patent Application No. PCT/US2014/019395, dated Sep. 9, 2014, 14 pages.
International Search Report and Written Opinion of the International Searching Authority, International Patent Application No. PCT/US2014/019469, dated Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al, Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, dated Oct. 18, 2014, 12 pages.
International Patent Application No. PCT/US2013/049407, International Search Report and Written Opinion, dated Jun. 18, 2014, 13 pages.
Parkins, et al., Narrowband and broadband active control in an enclosure using the acoustic energy density, J. Acoust. Soc. Am. Jul. 2000, pp. 192-203, vol. 108, issue 1, U.S.
International Patent Application No. PCT/US2015/022113, International Search Report and Written Opinion, dated Jul. 23, 2015, 13 pages.
Pfann, et al., "Lms Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
D. Senderowicz et al., "Low-Voltage Double-Sampled Delta-Sigma Converters," IEEE J. Solid-State Circuits, vol. 37, pp. 1215-1225, Dec. 1997, 13 pages.
P.J. Hurst and K.C. Dyer, "An improved double sampling scheme for switched-capacitor delta-sigma modulators," IEEE Int. Symp. Circuits Systems, May 1992, vol. 3, pp. 1179-1182, 4 pages.
Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech.
Booji, P.S., Berkhoff, A.P., Virtual sensors for local, three dimensional, broadband multiple-channel active noise control and the effects on the quiet zones, Proceedings of ISMA2010 including USD2010, pp. 151-166.
Combined Search and Examination Report, Application No. GB1512832.5, dated Jan. 28, 2016, 7 pages.
International Patent Application No. PCT/US2015/066260, International Search Report and Written Opinion, dated Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1519000.2, dated Apr. 21, 2016, 5 pages.
Second Examination Opinion Notice, Application No. 201480075300.4, dated Feb. 27, 2019.

* cited by examiner

SYSTEMS AND METHODS FOR PROVIDING ADAPTIVE PLAYBACK EQUALIZATION IN AN AUDIO DEVICE

FIELD OF DISCLOSURE

The present disclosure relates in general to adaptive noise cancellation in connection with an acoustic transducer, and more particularly, to providing for adaptive playback equalization in an audio device.

BACKGROUND

Personal audio devices, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events. Because the acoustic environment around personal audio devices such as wireless telephones can change dramatically, depending on the sources of noise that are present and the position of the device itself, it is desirable to adapt the noise canceling to take into account such environmental changes.

Some personal audio devices also include equalizers. Equalizers typically attempt to apply to a source audio signal an inverse of a response of the electro-acoustic path of the source audio signal through the transducer, in order to reduce the effects of the electro-acoustic path. In most traditional approaches, equalization is performed with a static equalizer. However, an adaptive equalizer may provide better output sound quality than a static equalizer, and thus, may be desirable in many applications.

SUMMARY

In accordance with the teachings of the present disclosure, the disadvantages and problems associated with improving audio performance of a personal audio device may be reduced or eliminated.

In accordance with embodiments of the present disclosure, a personal audio device may include a personal audio device housing, a transducer, an error microphone, and one or more processing circuits. The transducer may be coupled to the housing for reproducing an output audio signal including an equalized source audio signal for playback to a listener and an anti-noise signal for countering the effects of ambient audio sounds in an acoustic output of the transducer. The error microphone may be coupled to the housing in proximity to the transducer for providing an error microphone signal indicative of the acoustic output of the transducer and the ambient audio sounds at the transducer. The one or more processing circuits may implement: a noise cancellation system that generates the anti-noise signal to reduce the presence of the ambient audio sounds heard by the listener based at least on the error microphone signal and an adaptive playback equalization system that generates the equalized source audio signal from a source audio signal by adapting, based at least on the error microphone signal, a response of the adaptive playback equalization system to minimize a difference between the source audio signal and the error microphone signal.

In accordance with these and other embodiments of the present disclosure, a method may include receiving an error microphone signal indicative of an acoustic output of a transducer and ambient audio sounds at the acoustic output of the transducer. The method may also include generating an anti-noise signal to reduce the presence of the ambient audio sounds at the acoustic output of the transducer based at least on the error microphone signal. The method may further include generating an equalized source audio signal from a source audio signal by adapting, based at least on the error microphone signal, a response of the adaptive playback equalization system to minimize a difference between the source audio signal and the error microphone signal. The method may additionally include combining the anti-noise signal with the equalized source audio signal to generate an audio signal provided to the transducer.

In accordance with these and other embodiments of the present disclosure, an integrated circuit for implementing at least a portion of a personal audio device may include an output, an error microphone input, and one or more processing circuits. The output may be configured to provide a signal to a transducer including both an equalized source audio signal for playback to a listener and an anti-noise signal for countering the effect of ambient audio sounds in an acoustic output of the transducer. The error microphone may be configured to receive an error microphone signal indicative of the output of the transducer and the ambient audio sounds at the transducer. The one or more processing circuits may implement: a noise cancellation system that generates the anti-noise signal to reduce the presence of the ambient audio sounds heard by the listener based at least on the error microphone signal and an adaptive playback equalization system that generates the equalized source audio signal from a source audio signal by adapting, based at least on the error microphone signal, a response of the adaptive playback equalization system to minimize a difference between the source audio signal and the error microphone signal.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
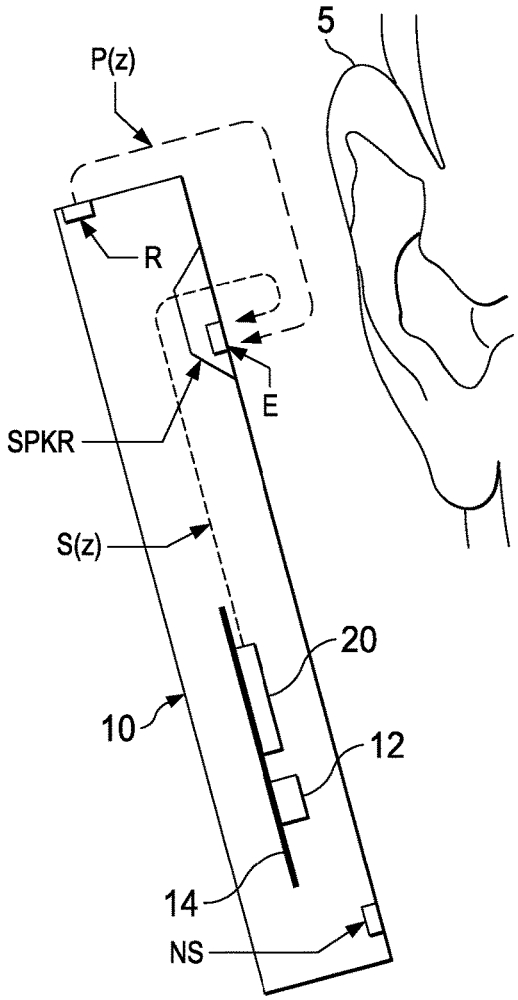
FIG. 1A is an illustration of an example personal audio device, in accordance with embodiments of the present disclosure.

Referring now to FIG. 1A, a personal audio device 10 as illustrated in accordance with embodiments of the present disclosure is shown in proximity to a human ear 5. Personal audio device 10 is an example of a device in which techniques in accordance with embodiments of the invention may be employed, but it is understood that not all of the elements or configurations embodied in illustrated personal audio device 10, or in the circuits depicted in subsequent illustrations, are required in order to practice the invention recited in the claims. Personal audio device 10 may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. A near-speech microphone NS may be provided to capture near-end speech, which is transmitted from personal audio device 10 to the other conversation participant(s).

Personal audio device 10 may include adaptive noise cancellation (ANC) circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when personal audio device 10 is in close proximity to ear 5. Circuit 14 within personal audio device 10 may include an audio CODEC integrated circuit (IC) 20 that receives the signals from reference microphone R, near-speech microphone NS, and error microphone E, and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of personal audio device 10 adapt an anti-noise signal generated out the output of speaker SPKR from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to personal audio device 10, when personal audio device 10 is not firmly pressed to ear 5. While the illustrated personal audio device 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes. In addition, although only one reference microphone R is depicted in FIG. 1, the circuits and techniques herein disclosed may be adapted, without changing the scope of the disclosure, to personal audio devices including a plurality of reference microphones.

Figure 1B:
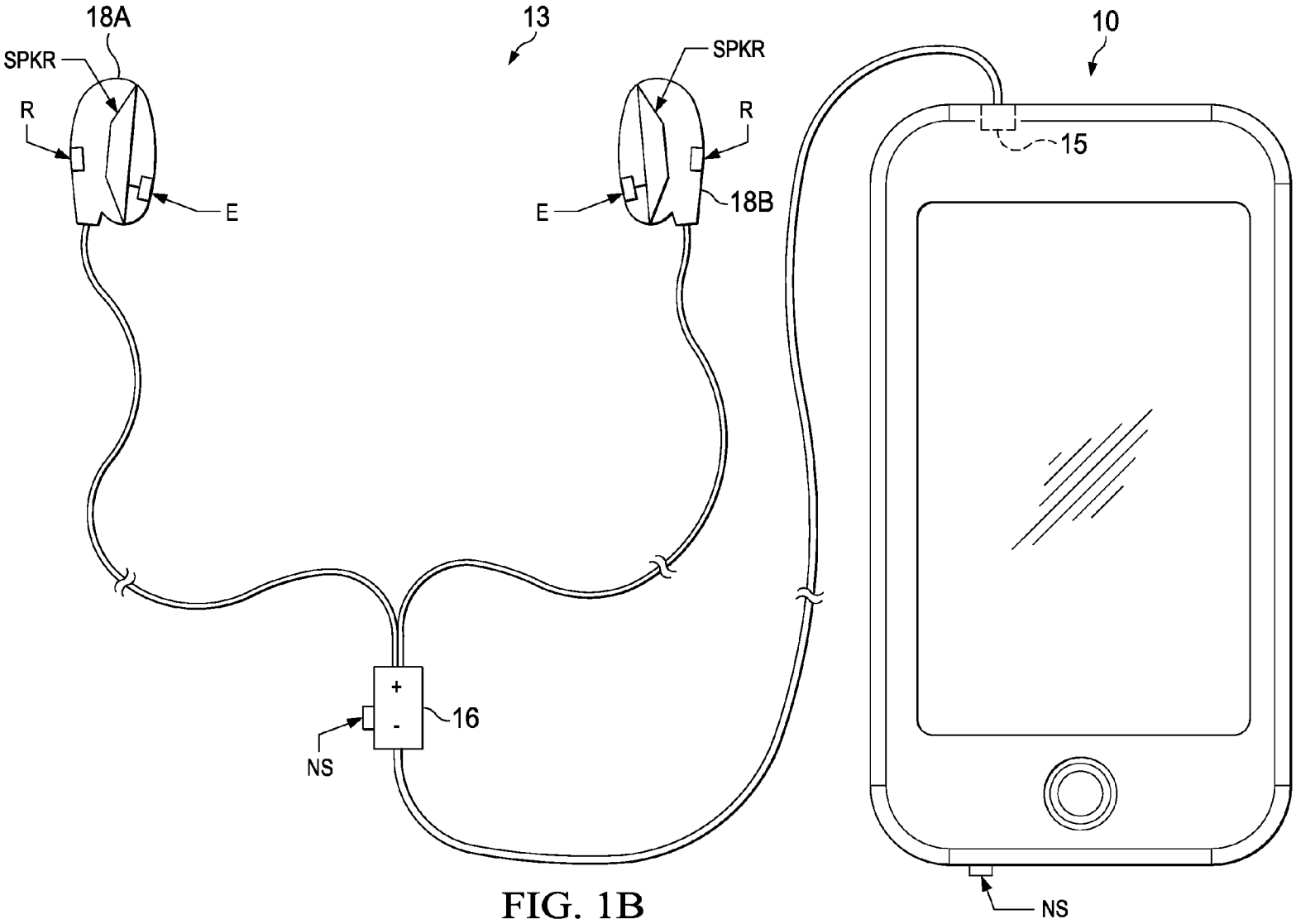
FIG. 1B is an illustration of an example personal audio device with a headphone assembly coupled thereto, in accordance with embodiments of the present disclosure.

Referring now to FIG. 1B, personal audio device 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear or ear canal, and includes without limitation earphones, earbuds, and other similar devices. As more specific non-limiting examples, "headphone," may refer to intra-canal earphones, intra-concha earphones, supra-concha earphones, and supra-aural earphones.

Combox 16 or another portion of headphone assembly 13 may have a near-speech microphone NS to capture near-end speech in addition to or in lieu of near-speech microphone NS of personal audio device 10. In addition, each headphone 18A, 18B may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

The various microphones referenced in this disclosure, including reference microphones, error microphones, and near-speech microphones, may comprise any system, device, or apparatus configured to convert sound incident at such microphone to an electrical signal that may be processed by a controller, and may include without limitation an electrostatic microphone, a condenser microphone, an electret microphone, an analog microelectromechanical systems (MEMS) microphone, a digital MEMS microphone, a piezoelectric microphone, a piezo-ceramic microphone, or dynamic microphone.

Figure 2:
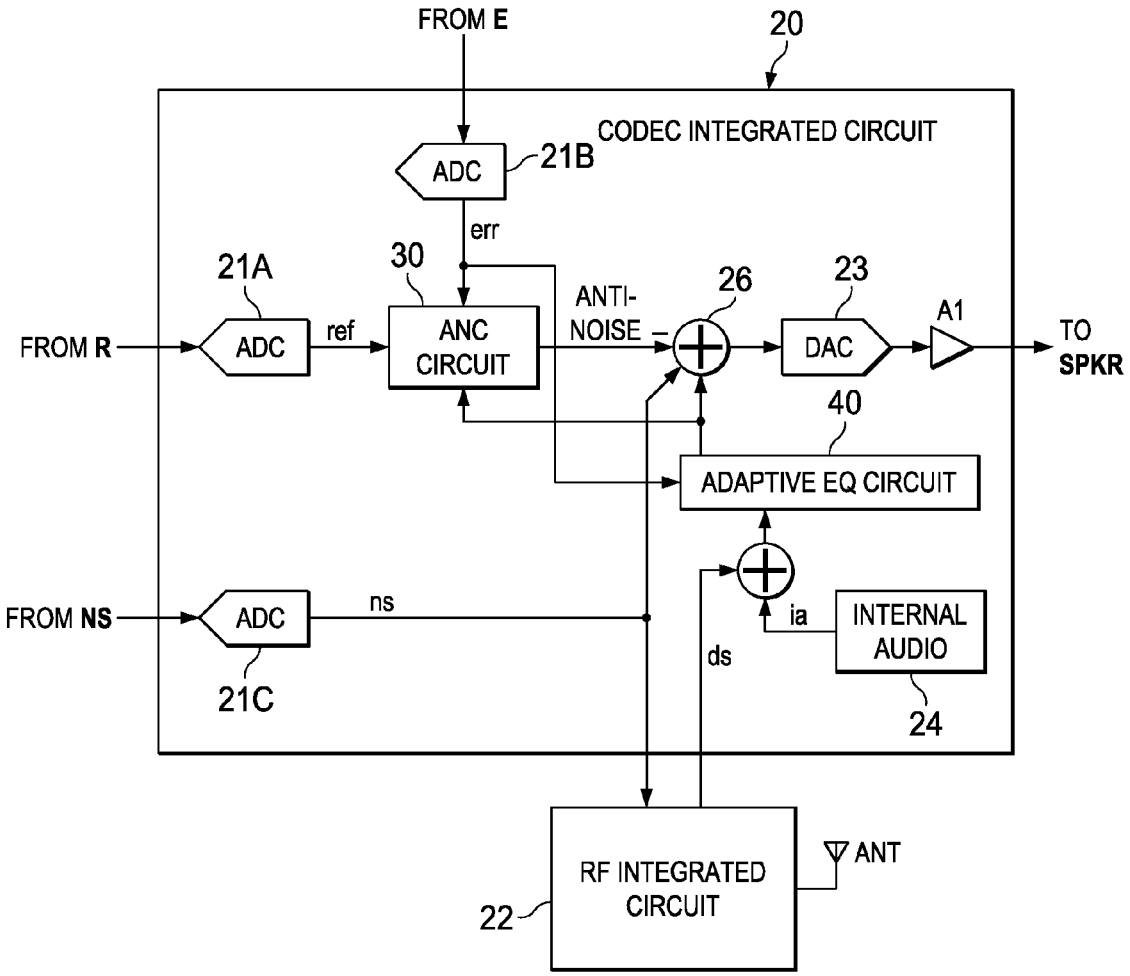
FIG. 2 is a block diagram of selected circuits within the personal audio device depicted in FIG. 1, in accordance with embodiments of the present disclosure.

Referring now to FIG. 2, selected circuits within personal audio device 10, which in other embodiments may be placed in whole or part in other locations such as one or more headphone assemblies 13, are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine an equalized source audio signal generated by adaptive equalization circuit 40 from audio signals is from internal audio sources 24 and/or downlink speech ds which may be received from radio frequency (RF) integrated circuit 22, the anti-noise signal generated by ANC circuit 30, which by convention has the same polarity as the noise in reference microphone signal ref and is therefore subtracted by combiner 26, and a portion of near speech microphone signal ns so that the user of personal audio device 10 may hear his or her own voice in proper relation to downlink speech ds. Near speech microphone signal ns may also be provided to RF integrated circuit 22 and may be transmitted as uplink speech to the service provider via antenna ANT.

Figure 3:
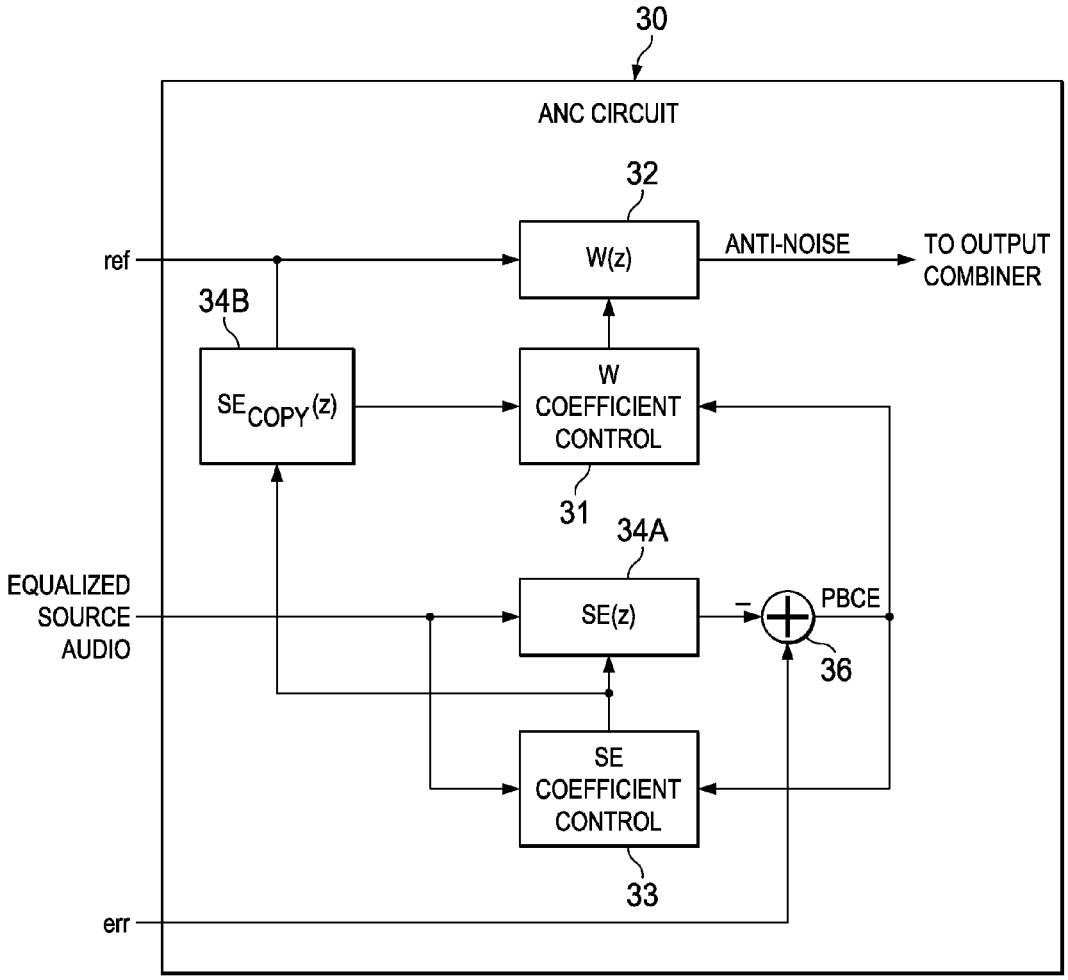
FIG. 3 is a block diagram depicting selected signal processing circuits and functional blocks within an example active noise canceling (ANC) circuit of a coder-decoder (CODEC) integrated circuit of FIG. 3, in accordance with embodiments of the present disclosure.

Referring now to FIG. 3, details of ANC circuit 30 are shown in accordance with embodiments of the present disclosure. Adaptive filter 32 may receive reference microphone signal ref and under ideal circumstances, may adapt its transfer function W(z) to be P(z)/S(z) to generate the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and a playback corrected error, labeled as "PBCE" in FIG. 3, based at least in part on error microphone signal err. The playback corrected error may be generated as described in greater detail below.

By transforming reference microphone signal ref with a copy of the estimate of the response of path S(z), response $SE_{COPY}(z)$ of filter 34B, and minimizing the difference between the resultant signal and error microphone signal err, adaptive filter 32 may adapt to the desired response of P(z)/S(z). In addition to error microphone signal err, the signal compared to the output of filter 34B by W coefficient control block 31 may include an inverted amount of equalized source audio signal (e.g., downlink audio signal ds and/or internal audio signal ia), that has been processed by filter response SE(z), of which response $SE_{COPY}(z)$ is a copy. By injecting an inverted amount of equalized source audio signal, adaptive filter 32 may be prevented from adapting to the relatively large amount of equalized source audio signal present in error microphone signal err. However, by transforming that inverted copy of equalized source audio signal with the estimate of the response of path S(z), the equalized source audio that is removed from error microphone signal err should match the expected version of the equalized source audio signal reproduced at error microphone signal err, because the electrical and acoustical path of S(z) is the path taken by the equalized source audio signal to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare the equalized source audio signal and a playback corrected error. The playback corrected error may be equal to error microphone signal err after removal of the equalized source audio signal (as filtered by filter 34A to represent the expected playback audio delivered to error microphone E) by a combiner 36. SE coefficient control block 33 may correlate the actual equalized source audio signal with the components of the equalized source audio signal that are present in error microphone signal err. Adaptive filter 34A may thereby be adapted to generate a secondary estimate signal from the equalized source audio signal, that when subtracted from error microphone signal err to generate the playback corrected error, includes the content of error microphone signal err that is not due to the equalized source audio signal.

Although FIGS. 2 and 3 depict a feedforward ANC system in which an anti-noise signal is generated from a filtered reference microphone signal, any other suitable ANC system employing an error microphone may be used in connection with the methods and systems disclosed herein. For example, in some embodiments, an ANC circuit employing feedback ANC, in which anti-noise is generated from a playback corrected error signal, may be used instead of or in addition to feedforward ANC, as depicted in FIGS. 2 and 3.

Figure 4:
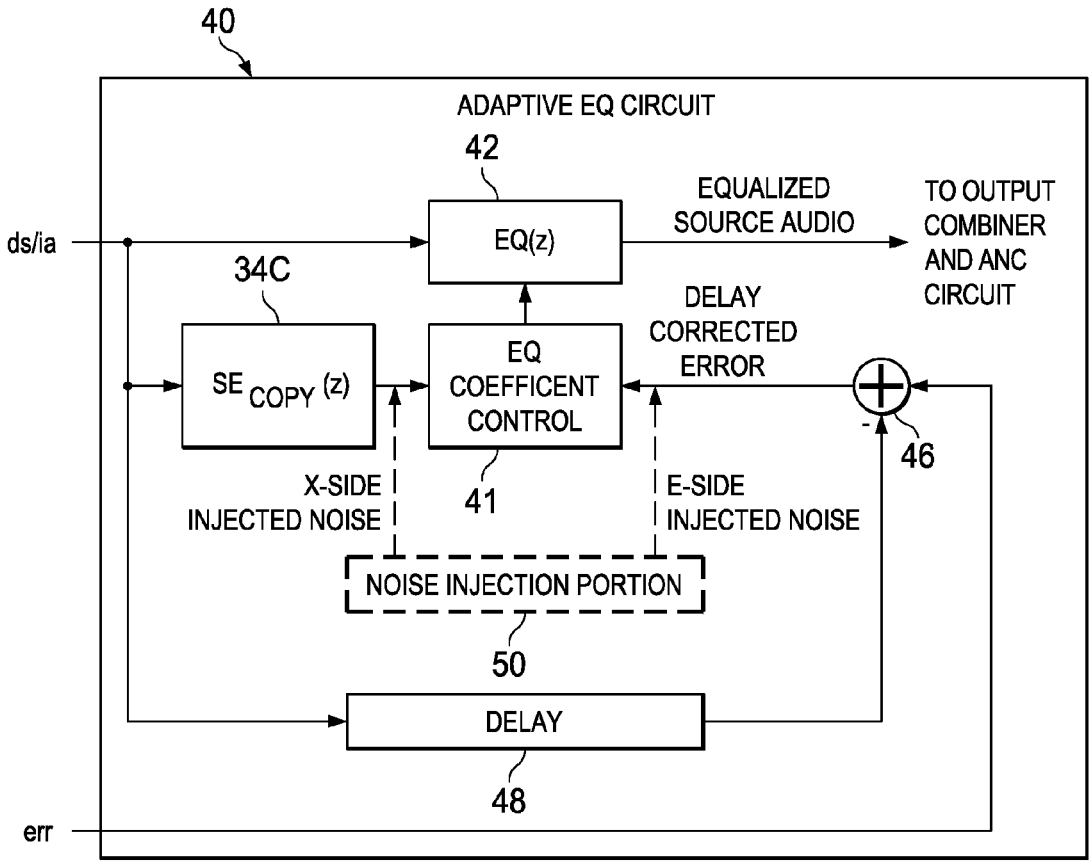
FIG. 4 is a block diagram depicting selected signal processing circuits and functional blocks within an example adaptive equalization circuit of a coder-decoder (CODEC) integrated circuit of FIG. 3, in accordance with embodiments of the present disclosure.

Referring now to FIG. 4, details of adaptive equalizer circuit 40 are shown in accordance with embodiments of the present disclosure. Adaptive equalization filter 42 may receive the source audio signal (e.g., downlink speech ds and/or internal audio ia) and under ideal circumstances, may adapt its transfer function EQ(z) to be Delay/S(z) (wherein Delay is a signal delay added to a signal by delay element 48, as described in greater detail below) to generate the equalized source audio signal, which may be provided to ANC circuit 30 (as described above) and provided to an output combiner that combines the anti-noise signal with the equalized source audio signal to be reproduced by the transducer, as exemplified by combiner 26 of FIG. 2. The coefficients of adaptive equalization filter 42 may be controlled by an equalizer coefficient control block 41 that uses a correlation of signals to determine the response EQ(z) of adaptive equalization filter 42, which generally minimizes the error, in a least-mean squares sense, between the delayed source audio signal and the error microphone signal err, as described in greater detail below.

To implement the above, adaptive equalization filter 42 may have coefficients controlled by equalizer coefficient control block 41, which may compare a source audio signal and a delay corrected error. The source audio signal may include downlink audio signal ds and/or internal audio signal ia. The delay corrected error may be equal to error microphone signal err after removal of the source audio signal (as delayed by a delay block 48) by a combiner 46. Equalization coefficient control block 41 may correlate the actual source audio signal with the components of the source audio signal that are present in error microphone signal err. The signals compared by equalizer coefficient control block 41 may be the source audio signal as shaped by a copy of an estimate of the response of path S(z) provided by filter 34C and a delay corrected error, based at least in part on error microphone signal err.

In some embodiments, adaptive equalization filter 42 may comprise a shelving filter, as is known in the art. In such embodiments, at least one of a pole frequency and a zero frequency of the shelving filter may be variable based on the error microphone signal.

As mentioned above, in addition to error microphone signal err, the signal compared to the output of filter 34C by equalizer coefficient control block 41 may include a delayed amount source audio signal (e.g., downlink audio signal ds and/or internal audio signal ia), that has been delayed by delay block 48. By delaying the source audio signal by at least the delay of the secondary path represented by S(z), the system formed by adaptive equalization circuit 40 may operate as a causal system.

In some embodiments, a noise injection portion 50 may inject noise into each side of equalizer coefficient control block 41, as shown in FIG. 4. For example, noise injection portion 50 may inject an x-side injected noise signal into the filtered source audio signal generated by filter 34C (e.g., by a combiner which is not explicitly shown) and an e-side injected noise signal into the delay corrected error (e.g., by combiner 46 or another combiner which is not explicitly shown).

Figure 5:
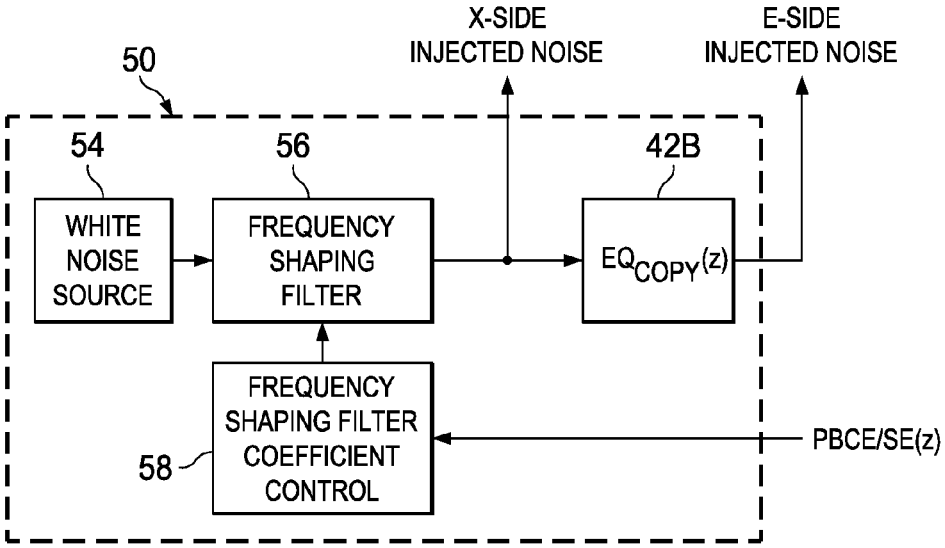
FIG. 5 is a block diagram depicting selected signal processing circuits and functional blocks within an example noise injection portion of an adaptive equalization circuit of FIG. 4, in accordance with embodiments of the present disclosure.

Referring now to FIG. 5, details of a noise injection portion 50, which may be present in some embodiments of adaptive equalizer circuit 40 in or are shown in accordance with embodiments of the present disclosure. Noise injection portion 50 may include a white noise source 54 for generating white noise (e.g., an audio signal with a constant amplitude across all frequencies of interest, such as those frequencies within the range of human hearing). A frequency shaping filter 56 may generate the x-side injected noise signal by filtering the white noise signal, wherein a response of the frequency shaping filter is shaped by frequency shaping filter coefficient control block 58 in conformity with the playback corrected error, response SE(z) of filter 34A, or other suitable signal or response. In some embodiments, coefficient control block 58 may implement an adaptive linear prediction coefficient system which estimates a frequency spectrum of the playback corrected error, response SE(z) of filter 34A, or other suitable signal or response received by noise injection portion 50. Accordingly, the noise signal generated by frequency shaping filter 56 may comprise the white noise signal filtered such that the white noise signal is attenuated or eliminated in those frequencies within the frequency spectrum of the playback corrected error, such that the output of frequency shaping filter 56 has a frequency spectrum with greater magnitude content at frequencies in which the playback corrected error, response SE(z) of filter 34A, or other suitable signal or response received by noise injection portion 50 is at or is substantially near zero. In these and other embodiments, noise injection portion 50 may include an adaptive equalizer filter 42B, which may be a copy of adaptive equalization filter 42, wherein adaptive equalizer filter 42B applies its response $EQ_{COPY}(z)$ to the x-side injection noise, in order to generate the e-side injection noise signal. The injected noise signals may serve to bias, to below a predetermined maximum, a magnitude of the response of adaptive equalization filter 42 corresponding to a frequency in which the response of secondary path estimate filter 34C is substantially zero.

In addition to or alternatively to the noise injection described above, other approaches may be used in order to limit magnitudes of the response of adaptive equalization filter 42 at frequencies corresponding to nulls in the response SE(z) below a predetermined acceptable level. For example, in some embodiments, a number of coefficients of adaptive equalizer filter 42 and equalizer coefficient control block 41 may be selected in order to limit magnitudes of the response of adaptive equalization filter 42 at frequencies corresponding to nulls in the response SE(z) below a predetermined acceptable level.

In these and other embodiments, the response of adaptive equalizer filter 42 may be disabled from adapting when conditions are present that may hinder the ability of adaptive equalizer filter 42 to converge or adapt. For example, the response of adaptive equalizer filter 42 may be disabled from adapting when the spectral density of the source audio signal is lesser than a minimum spectral density. As another example, the response of adaptive equalizer filter 42 may be disabled from adapting when a transducer has been removed from a proximity of an ear of a listener (which may be determined as described in U.S. patent application Ser. No. 13/844,602 filed Mar. 15, 2013, entitled "Monitoring of Speaker Impedance to Detect Pressure Applied Between Mobile Device in Ear," as described in U.S. patent application Ser. No. 13/310,380 filed Dec. 2, 2011, entitled "Ear-Coupling Detection and Adjustment of Adaptive Response in Noise-Cancelling in Personal Audio Devices," or as otherwise known in the art). As an additional example, the response of adaptive equalizer filter 42 may be disabled from adapting when "clipping" may occur, as indicated by a magnitude of the audio output signal driving a transducer being within a predetermined threshold of a magnitude of a power supply for driving the output audio signal. As a further example, the response of adaptive equalizer filter 42 may be disabled from adapting when a physical displacement of a transducer is such that its displacement as a function of the output audio signal driving the transducer is substantially nonlinear.

In some embodiments, the sequencing of adaptation of response SE(z) of filter 34A and response EQ(z) of adaptive equalization filter 42 may be configured to ensure stability of adaptation of response SE(z) and response EQ(z). For example, in such embodiments, CODEC IC 20 may be configured to train response SE(z) prior to training of response EQ(z), as response EQ(z) relies on response $SE_{COPY}(z)$ for stability. After both responses SE(z) and EQ(z) have been trained, training may alternate between the responses. As another example, CODEC IC 20 may be configured to such that response EQ(z) trains only while response SE(z) is training, again because response EQ(z) relies on response $SE_{COPY}(z)$ for stability. As a further example, CODEC IC 20 may be configured such that response EQ(z) adapts at a slower rate than response SE(z).

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A personal audio device comprising:

a personal audio device housing;

a transducer coupled to the housing for reproducing an output audio signal including an equalized source audio signal for playback to a listener and an anti-noise signal for countering the effects of ambient audio sounds in an acoustic output of the transducer;

an error microphone coupled to the housing in proximity to the transducer for providing an error microphone signal indicative of the acoustic output of the transducer and the ambient audio sounds at the transducer;

one or more processing circuits that implement:

a noise cancellation system that generates the anti-noise signal to reduce the presence of the ambient audio sounds heard by the listener based at least on the error microphone signal;

an adaptive playback equalization system that generates the equalized source audio signal from a source audio signal by adapting, based at least on the error microphone signal, a response of the adaptive playback equalization system to minimize a difference between the source audio signal and the error microphone signal, wherein the adaptive playback equalization system comprises:

an adaptive equalization filter having a response that generates the equalized source audio signal from the source audio signal to reduce the effects of an electro-acoustical path of the source audio signal through the transducer;

a coefficient control block that shapes the response of the adaptive equalization filter in conformity with the error microphone signal and the source audio signal by adapting the response of the adaptive equalization filter to minimize the difference between the error microphone signal and the source audio signal; and a secondary path estimate filter for modeling the electro-acoustical path and having a response that generates a secondary path estimate from the source audio signal and wherein the coefficient control block shapes the response of the adaptive equalization filter in conformity with the secondary path estimate and a delay corrected error, wherein the delay corrected error is based on a difference between the error microphone signal and a delayed source audio signal;

a noise injection portion for injecting respective noise signals into the secondary path estimate and the delay corrected error in order to bias, to below a predetermined maximum, a magnitude of the response of the adaptive equalization filter corresponding to a frequency in which the response of the secondary path estimate filter is substantially zero.

2. The personal audio device of claim 1, wherein the adaptive equalization filter comprises a shelving filter, wherein at least one of a pole frequency and a zero frequency of the shelving filter are variable based on the error microphone signal.

3. The personal audio device of claim 1, wherein the one or more processing circuits implement a second coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

4. The personal audio device of claim 1, wherein a number of coefficients of the coefficient control block is selected such that a magnitude of the response of the adaptive equalization filter corresponding to a frequency in which the response of the secondary path estimate filter is substantially zero is limited below a predetermined maximum.

5. The personal audio device of claim 1, wherein the one or more processing circuits disable the response of the adaptive playback equalization system from adapting responsive to at least one of:

a determination that a spectral density of the source audio signal is lesser than a minimum spectral density;

a determination that the transducer has been removed from a proximity of an ear of the listener;

a determination that a magnitude of the output audio signal is within a predetermined threshold of a magnitude of a power supply for driving the output audio signal; and a determination that a displacement of the transducer is such that its displacement as a function of the output audio signal is substantially nonlinear.

6. The personal audio device of claim 1, further comprising a reference microphone coupled to the housing for providing a reference microphone signal indicative of the ambient audio sounds, wherein the noise cancellation system further comprises:

an adaptive filter having a response that generates the anti-noise signal from the reference microphone signal to reduce the presence of the ambient audio sounds heard by the listener; and a coefficient control block that shapes the response of the adaptive filter in conformity with the error microphone signal and the reference microphone signal by adapting the response of the adaptive filter to minimize the ambient audio sounds in the error microphone signal.

7. The personal audio device of claim 1, further comprising a reference microphone coupled to the housing for providing a reference microphone signal indicative of the ambient audio sounds, wherein the noise cancellation system further comprises:

a filter having a response that generates the anti-noise signal from the reference microphone signal to reduce the presence of the ambient audio sounds heard by the listener;

a secondary path estimate adaptive filter for modeling an electro-acoustical path of the source audio signal and having a response that generates a secondary path estimate from the equalized source audio signal; and a coefficient control block that shapes the response of the secondary path estimate adaptive filter in conformity with the equalized source audio signal and a playback corrected error by adapting the response of the secondary path estimate filter to minimize the playback corrected error, wherein the playback corrected error is based on a difference between the error microphone signal and the secondary path estimate.

8. The personal audio device of claim 7, wherein the one or more processing circuits are configured to adapt the response of the secondary path estimate adaptive filter prior to adapting the response of the adaptive playback equalization system.

9. The personal audio device of claim 8, wherein the one or more processing circuits are configured to alternate adaptation of the secondary path estimate adaptive filter and the response of the adaptive playback equalization system.

10. The personal audio device of claim 7, wherein the one or more processing circuits are configured to adapt the response of the adaptive playback equalization system only when the secondary path estimate adaptive filter is adapting.

11. The personal audio device of claim 7, wherein the one or more processing circuits are configured to adapt the response of the adaptive playback equalization system at a rate slower than the rate of adaptation of the secondary path estimate adaptive filter.

12. A method comprising:

receiving an error microphone signal indicative of an acoustic output of a transducer and ambient audio sounds at the acoustic output of the transducer;

generating an anti-noise signal to reduce the presence of the ambient audio sounds at the acoustic output of the transducer based at least on the error microphone signal;

generating an equalized source audio signal from a source audio signal by adapting, based at least on the error microphone signal, a response of an adaptive playback equalization system to minimize a difference between the source audio signal and the error microphone signal, wherein the equalized source audio signal is generated by an adaptive equalization filter having a response that generates the equalized source audio signal from the source audio signal to reduce the effects of an electro-acoustical path of the source audio signal through the transducer, and the method further comprising shaping the response of the adaptive equalization filter in conformity with the error microphone signal and the source audio signal by adapting the response of the adaptive equalization filter to minimize the difference between the error microphone signal and the source audio signal;

generating a secondary path estimate from the source audio signal by filtering the source audio signal with a secondary path estimate filter modeling an electro-acoustical path of the source audio signal; and wherein shaping the response of the adaptive equalization filter comprises shaping the response of the adaptive equalization filter in conformity with the secondary path estimate and a delay corrected error, wherein the delay corrected error is based on a difference between the error microphone signal and a delayed source audio signal;

injecting respective noise signals into the secondary path estimate and the delay corrected error in order to bias, to below a predetermined maximum, a magnitude of the response of the adaptive equalization filter corresponding to a frequency in which the response of the secondary path estimate filter is substantially zero; and combining the anti-noise signal with the equalized source audio signal to generate an audio signal provided to the transducer.

13. The method of claim 12, wherein the adaptive equalization filter comprises a shelving filter, wherein at least one of a pole frequency and a zero frequency of the shelving filter are variable based on the error microphone signal.

14. The method of claim 12, further comprising shaping the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

15. The method of claim 12, wherein the response of the adaptive equalization filter is shaped by a coefficient control block, and a number of coefficients of the coefficient control block is selected such that a magnitude of the response of the adaptive equalization filter corresponding to a frequency in which the response of the secondary path estimate filter is substantially zero is limited below a predetermined maximum.

16. The method of claim 12, further comprising disabling the response of the adaptive playback equalization system from adapting responsive to at least one of:

a determination that a spectral density of the source audio signal is lesser than a minimum spectral density;

a determination that the transducer has been removed from a proximity of an ear of the listener;

a determination that a magnitude of the output audio signal is within a predetermined threshold of a magnitude of a power supply for driving the output audio signal; and a determination that a displacement of the transducer is such that its displacement as a function of the output audio signal is substantially nonlinear.

17. The method of claim 12, further comprising:

receiving a reference microphone signal indicative of the ambient audio sounds; and generating the anti-noise signal from filtering the reference microphone signal with an adaptive filter to reduce the presence of the ambient audio sounds heard by the listener by shaping the response of the adaptive filter in conformity with the error microphone signal and the reference microphone signal by adapting the response of the adaptive filter to minimize the ambient audio sounds in the error microphone signal.

18. The method of claim 12, further comprising:

receiving a reference microphone signal indicative of the ambient audio sounds;

generating the anti-noise signal from the reference microphone signal to reduce the presence of the ambient audio sounds heard by the listener;

generating a secondary path estimate from the equalized source audio signal by filtering the equalized source audio signal with a secondary path estimate filter modeling an electro-acoustical path of the source audio signal; and shaping the response of the secondary path estimate filter in conformity with the equalized source audio signal and a playback corrected error by adapting the response of the secondary path estimate filter to minimize the playback corrected error, wherein the playback corrected error is based on a difference between the error microphone signal and the secondary path estimate.

19. The method of claim 18, wherein the response of the secondary path estimate adaptive filter adapts prior to adaptation of the response of the adaptive playback equalization system.

20. The method of claim 19, further comprising alternating adaptation of the secondary path estimate adaptive filter and the response of the adaptive playback equalization system.

21. The method of claim 18, further comprising adapting the response of the adaptive playback equalization system only when the secondary path estimate adaptive filter is adapting.

22. The method claim 18, further comprising adapting the response of the adaptive playback equalization system at a rate slower than the rate of adaptation of the secondary path estimate adaptive filter.

23. An integrated circuit for implementing at least a portion of a personal audio device, comprising:

an output for providing a signal to a transducer including both an equalized source audio signal for playback to a listener and an anti-noise signal for countering the effect of ambient audio sounds in an acoustic output of the transducer;

an error microphone input for receiving an error microphone signal indicative of the acoustic output of the transducer and the ambient audio sounds at the transducer; and one or more processing circuits that implement:

a noise cancellation system that generates the anti-noise signal to reduce the presence of the ambient audio sounds heard by the listener based at least on the error microphone signal; and an adaptive playback equalization system that generates the equalized source audio signal from a source audio signal by adapting, based at least on the error microphone signal, a response of the adaptive playback equalization system to minimize a difference between the source audio signal and the error microphone signal; wherein the adaptive playback equalization system comprises:

an adaptive equalization filter having a response that generates the equalized source audio signal from the source audio signal to reduce the effects of an electro-acoustical path of the source audio signal through the transducer;

a coefficient control block that shapes the response of the adaptive equalization filter in conformity with the error microphone signal and the source audio signal by adapting the response of the adaptive equalization filter to minimize the difference between the error microphone signal and the source audio signal; and a secondary path estimate filter for modeling the electro-acoustical path and having a response that generates a secondary path estimate from the source audio signal and wherein the coefficient control block shapes the response of the adaptive equalization filter in conformity with the secondary path estimate and a delay corrected error, wherein the delay corrected error is based on a difference between the error microphone signal and a delayed source audio signal; and a noise injection portion for injecting respective noise signals into the secondary path estimate and the delay corrected error in order to bias, to below a predetermined maximum, a magnitude of the response of the adaptive equalization filter corresponding to a frequency in which the response of the secondary path estimate filter is substantially zero.

24. The integrated circuit of claim 23, wherein the adaptive equalization filter comprises a shelving filter, wherein at least one of a pole frequency and a zero frequency of the shelving filter are variable based on the error microphone signal.

25. The integrated circuit of claim 23, wherein the one or more processing circuits implement a second coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

26. The integrated circuit of claim 23, wherein a number of coefficients of the coefficient control block is selected such that a magnitude of the response of the adaptive equalization filter corresponding to a frequency in which the response of the secondary path estimate filter is substantially zero is limited below a predetermined maximum.

27. The integrated circuit of claim 23, wherein the one or more processing circuits disable the response of the adaptive playback equalization system from adapting responsive to at least one of:

a determination that a spectral density of the source audio signal is lesser than a minimum spectral density;

a determination that the transducer has been removed from a proximity of an ear of the listener;

a determination that a magnitude of the output audio signal is within a predetermined threshold of a magnitude of a power supply for driving the output audio signal; and a determination that a displacement of the transducer is such that its displacement as a function of the output audio signal is substantially nonlinear.

28. The integrated circuit of claim 23, further comprising a reference microphone input for receiving a reference microphone signal indicative of the ambient audio sounds, wherein the noise cancellation system further comprises:

an adaptive filter having a response that generates the anti-noise signal from the reference microphone signal to reduce the presence of the ambient audio sounds heard by the listener; and a coefficient control block that shapes the response of the adaptive filter in conformity with the error microphone signal and the reference microphone signal by adapting the response of the adaptive filter to minimize the ambient audio sounds in the error microphone signal.

29. The integrated circuit of claim 23, further comprising a reference microphone input for receiving a reference microphone signal indicative of the ambient audio sounds, wherein the noise cancellation system further comprises:

a filter having a response that generates the anti-noise signal from the reference microphone signal to reduce the presence of the ambient audio sounds heard by the listener;

a secondary path estimate adaptive filter for modeling an electro-acoustical path of the source audio signal and having a response that generates a secondary path estimate from the equalized source audio signal; and a coefficient control block that shapes the response of the secondary path estimate adaptive filter in conformity with the equalized source audio signal and a playback corrected error by adapting the response of the secondary path estimate adaptive filter to minimize the playback corrected error, wherein the playback corrected error is based on a difference between the error microphone signal and the secondary path estimate.

30. The integrated circuit of claim 29, wherein the one or more processing circuits are configured to adapt the response of the secondary path estimate adaptive filter prior to adapting the response of the adaptive playback equalization system.

31. The integrated circuit of claim 30, wherein the one or more processing circuits are configured to alternate adaptation of the secondary path estimate adaptive filter and the response of the adaptive playback equalization system.

32. The integrated circuit of claim 29, wherein the one or more processing circuits are configured to adapt the response of the adaptive playback equalization system only when the secondary path estimate adaptive filter is adapting.

33. The integrated circuit of claim 29, wherein the one or more processing circuits are configured to adapt the response of the adaptive playback equalization system at a rate slower than the rate of adaptation of the secondary path estimate adaptive filter.

* * * * *